US010393351B2

(12) United States Patent
Chen

(10) Patent No.: US 10,393,351 B2
(45) Date of Patent: Aug. 27, 2019

(54) ILLUMINANT DECORATION DEVICE

(71) Applicant: TAIZHOU HEYSTAR ELECTRONIC TECHNOLOGY CO., LTD, Linhai, Zhejiang Province (CN)

(72) Inventor: Yingping Chen, Linhai (CN)

(73) Assignee: TAIZHOU HEYSTAR ELECTRONIC TECHNOLOGY CO., LTD (CN)

( * ) Notice: Subject to any disclaimer, the term of this patent is extended or adjusted under 35 U.S.C. 154(b) by 0 days.

(21) Appl. No.: 15/627,454

(22) Filed: Jun. 20, 2017

(65) Prior Publication Data

US 2017/0363273 A1 Dec. 21, 2017

(30) Foreign Application Priority Data

Jun. 20, 2016 (CN) ..... 2016 2 0604460 U

(51) Int. Cl.

| | |
|---|---|
| ***F21S 4/10*** | (2016.01) |
| ***F21V 3/00*** | (2015.01) |
| ***F21V 17/10*** | (2006.01) |
| ***F21V 17/16*** | (2006.01) |
| ***F21V 23/00*** | (2015.01) |
| ***F21W 121/00*** | (2006.01) |
| ***F21Y 115/10*** | (2016.01) |

(52) U.S. Cl.

CPC ..... *F21V 17/16* (2013.01); *F21S 4/10* (2016.01); *F21V 3/00* (2013.01); *F21V 17/101* (2013.01); *F21V 23/001* (2013.01); *F21W 2121/00* (2013.01); *F21Y 2115/10* (2016.08)

(58) Field of Classification Search

CPC ..... F21Y 2101/02; F21K 9/00; F21S 4/001; F21S 4/003; F21S 4/10; F21V 19/0005; F21W 2121/00

USPC ..... 362/249.02, 249.06, 249.14, 249.16, 362/249.19

See application file for complete search history.

(56) References Cited

U.S. PATENT DOCUMENTS

| | | | | |
|---|---|---|---|---|
| 5,934,793 A * | 8/1999 | Rahman | F21S 10/00 | 362/123 |
| 6,347,965 B1 * | 2/2002 | Pan | H01R 33/09 | 439/699.2 |
| 6,398,386 B1 * | 6/2002 | Huang | F21V 19/0005 | 362/249.01 |
| 6,600,256 B2 * | 7/2003 | Van Lier | H01J 5/54 | 313/313 |

(Continued)

*Primary Examiner* — Alexander K Garlen
(74) *Attorney, Agent, or Firm* — PROI Intellectual Property US

(57) ABSTRACT

The disclosure provides an illuminant decoration device comprising a lampshade, a clamping seat and a light string. The light string comprises a lamp cap assembly and a lead wire interconnecting the lamp cap assemblies, which comprises a lead wire end, an LED bulb, an isolating pillar and a heat shrinkable sleeve. The LED bulb has a positive electrode bulb pin and a negative electrode bulb pin, the lead wire end is electrically connected to the positive electrode bulb pin and the negative electrode bulb pin respectively through the lead wire, the isolating pillar is arranged between the two electrical connection bodies, and the heat shrinkable sleeve is wrapped on the outside of the entirety composed of the lead wire end, the LED bulb and the isolating pillar.

3 Claims, 2 Drawing Sheets

(56) References Cited

U.S. PATENT DOCUMENTS

| | | | | |
|---|---|---|---|---|
| 6,630,773 | B1 * | 10/2003 | Huang | F21V 3/00 313/317 |
| 7,637,633 | B2 * | 12/2009 | Wong | F21K 9/00 362/294 |
| 8,511,871 | B2 * | 8/2013 | Liu | F21V 19/0005 362/427 |
| 9,803,851 | B2 * | 10/2017 | Loomis | F21V 3/02 |
| 9,829,162 | B2 * | 11/2017 | Han | F21S 4/10 |
| 9,900,968 | B2 * | 2/2018 | Altamura | H05B 39/041 |
| 2007/0183153 | A1 * | 8/2007 | Yu | F21V 3/00 362/249.16 |
| 2009/0129099 | A1 * | 5/2009 | Fan | F21V 31/00 362/368 |
| 2013/0003390 | A1 * | 1/2013 | Wu | F21V 19/001 362/311.02 |
| 2013/0182439 | A1 * | 7/2013 | Tsai | F21V 23/06 362/249.06 |
| 2015/0211726 | A1 * | 7/2015 | Wu Lee | F21V 31/005 362/645 |

* cited by examiner

ILLUMINANT DECORATION DEVICE

CROSS REFERENCE TO RELATED APPLICATIONS

The present application claims priority to Chinese Patent Application CN 201620604460.X filed on Jun. 20, 2016.

TECHNICAL FIELD

The disclosure relates to an illuminant decoration device. The illuminant decoration device can be used, for example, on a Christmas light assembly.

BACKGROUD

Decorative lights are indispensable electronic decorative products for home, festival celebration, public place night scene decoration and so on, and they have a huge market scale.

At present, Christmas light assembly decoration devices available on the market are of two types. One type is, as shown in FIG. 2, of a buckling and pulling tubular structure, comprising an electric wire 1', a copper buckle 2', a ferrule 3', an insertion tube 4', an LED bulb 5', a lampshade 6', and so on. The specific technique for manufacturing this type of Christmas light assembly decoration device comprises the following steps: step 1, electric wire 1' cutting; step 2, wire stripping (the wire sheath at the wire end is stripped off to expose partial of the intermediate conductor); step 3, buckling wire (the copper buckle 2' is buckled to the wire end, and, by using the fastening feature due to the pressure generated by the deformation of copper materials, one clamping piece of the copper buckle is enclosed on the wire sheath of the wire end and the other clamping piece is enclosed on the intermediate conductor of the wire end, the clamping piece at the end part of the copper buckle stretches out of the wire end); step 4, pulling wire (the insertion tube 4' has a clamping groove therein, the lead wire and the copper clamping pieces that are buckled together are pulled into the clamping groove to be combined and connected); step 5, bulb pins penetration (two bulb pins of the LED bulb 5' respectively penetrate into two small holes of the ferrule 3', and, after in place, are bended by 180 degrees outwards); step 6, bulb insertion (the combined assembly of the ferrule 3' and the LED bulb 5' is tightly inserted into the insertion tube 4' having the wire pulled thereto, so that the bulb pins and the clamping pieces of the copper buckle 2' are in tight contact to achieve the purpose of conducting electricity, the fitting surfaces between the ferrule 3' and the insertion tube 4' are in tight fit to prevent they breaking away from each other); step 7, cap sleeving (the lampshade 6' is pressed into a fitting hole of the ferrule 3' of the above combination, and, in the hole, there is a snap ring, which clamps a bayonet of the lampshade 6' after the lampshade 6' is pressed into the hole so as to prevent the fall off of the lampshade 6').

The other type is of a welding structure; that is, firstly the light string is processed as an LED welding structure assembly as described in this disclosure, and then LED bulbs are directly inserted into lampshades and they are adhered together through glue.

The above two methods are traditional techniques. The first one has already shaped people's consumption habit in term of the condition of sharp bulb type glass lampshades; however, the technique is complex, and, for series-connected light strings, although special equipment is available on the market, the equipment has a complex structure, is expensive, is difficult to maintain, has low production efficiency and a low performance-to-price ratio, and has a major drawback of artificial production; for parallel-connected light strings, the production method is completely artificial production, the production efficiency is low, and, as the year-by-year increase in labor cost, the industry already confronts with survival challenges. For the second technique, it is mainly used for pendants of non-glass sharp bulb shapes; for sharp bulb type glass lampshades, the second technique obviously does not suit people's consumption habits; moreover, most of the packing heat shrinkable sleeve outside the welding conductor part is exposed, impacting the appearance of the product.

SUMMARY

The technical problem to be solved by the present disclosure is to provide an illuminant decoration device. The device can be, for example, used on a light assembly, such as one for Christmas decoration. This device has a simple structure, is suitable for realizing automatic mass production, and can effectively lower the production cost. The lampshade of the illuminant decoration device may have the shape designed as needed, and thus enhances the decorative effect; meanwhile, people's consumption habits are taken into account. This structure has excellent water resistance, so the light assembly can be used both indoors and outdoors.

In order to address the above problem, the present disclosure adopts a technical scheme as follows.

An illuminant decoration device that is configured, for example, for use on a Christmas light assembly, comprises a lampshade, a clamping seat and a light string; the light string includes a lamp cap assembly and a lead wire interconnecting the lamp cap assemblies; the lamp cap assembly includes a lead wire end, an LED bulb, an isolating pillar and a heat shrinkable sleeve; the LED bulb has a positive electrode bulb pin and a negative electrode bulb pin, the lead wire end is electrically connected to the positive electrode bulb pin and the negative electrode bulb pin respectively through the lead wire, the isolating pillar is arranged between the two electrical connection bodies, and the heat shrinkable sleeve is wrapped on the outside of the entirety composed of the lead wire end, the LED bulb and the isolating pillar; the lampshade and the clamping seat are connected by way of clamping, an inner hole is formed after the lampshade and the clamping seat are connected by way of clamping, the inner hole fits with the lamp cap assembly, and glue is filled between the inner hole and the lamp cap assembly.

Preferably, an arc clamping groove is arranged at the outer ring of the lampshade, a fin plate is arranged on the outside of the clamping seat, and the fin plate is provided with a fixture block fitting with the clamping groove.

Preferably, the lampshade is transparent.

Preferably, the lampshade is of a glass sharp bulb structure.

The illuminant decoration device according to the present disclosure offers the following advantages: this device has a simple structure, is suitable for to realizing automatic mass production and can effectively lowers the production cost; the lampshade may have the shape designed as needed, and thus enhances the decorative effect; meanwhile, people's consumption habits are taken in account; this structure has excellent water resistance and can be used both indoors and outdoors, and this device is provided with a lampshade, through which light rays become softer while the color and the shape become rich; in all, this device has a simple structure and low cost and is suitable for popularization.

BRIEF DESCRIPTION OF THE DRAWINGS

To more clearly describe the technical scheme in the embodiment of the disclosure or in existing technologies, drawings needed in the description of the embodiment or existing technologies are simply illustrated below; obviously, drawings described below are merely some embodiments of the disclosure; for the ordinary staff in the field, other drawings may be obtained according to these drawings without creative work.

DESCRIPTION OF THE EMBODIMENTS

Preferred embodiments of the disclosure are described below in detail in conjunction with the drawings, so that the advantages and features of the disclosure become more understandable by those skilled in the art; accordingly, the scope of protection of the disclosure is more clearly defined.

Figure 1:
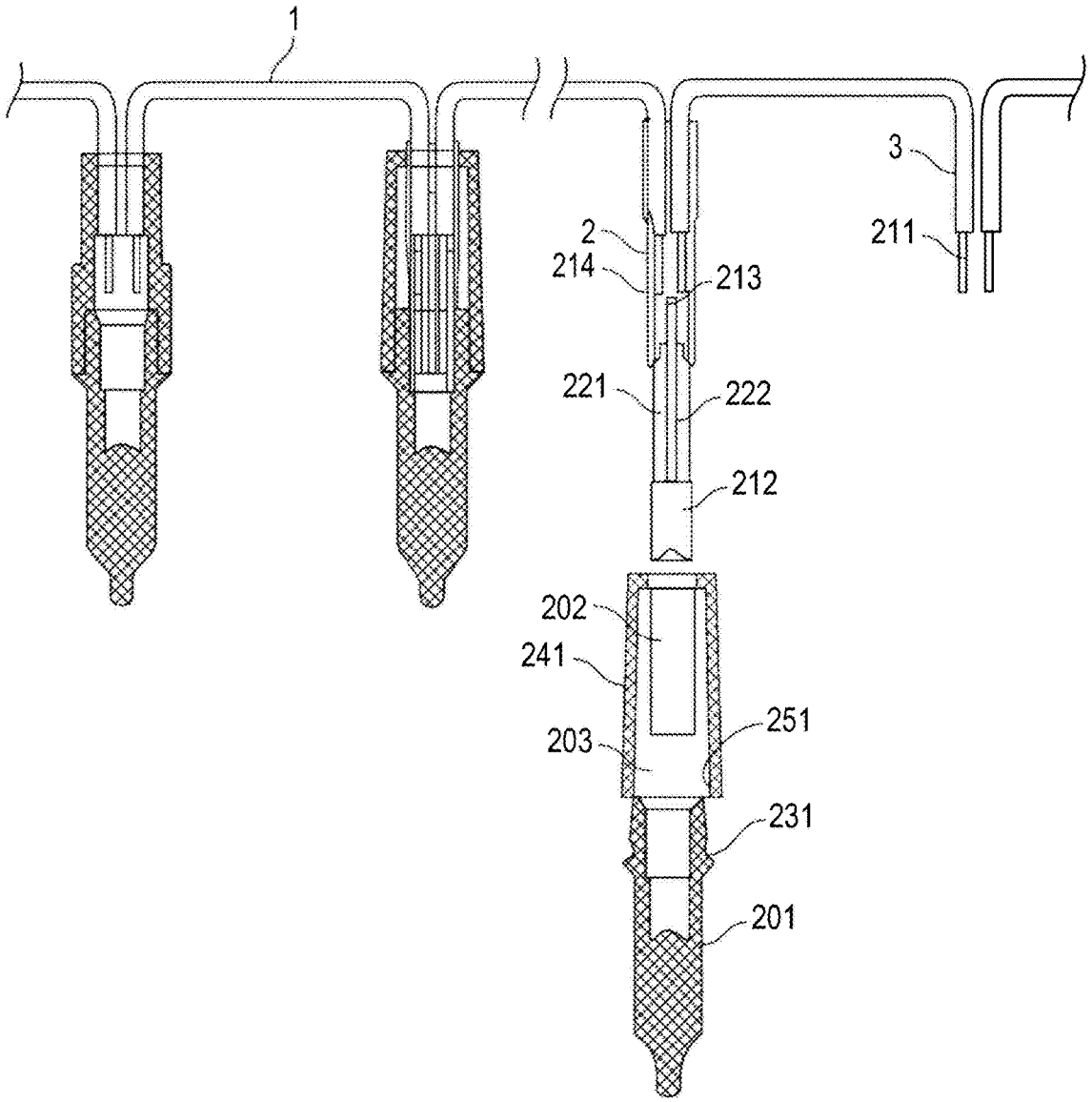
FIG. 1 is a structure diagram of the disclosure.
Figure 2:
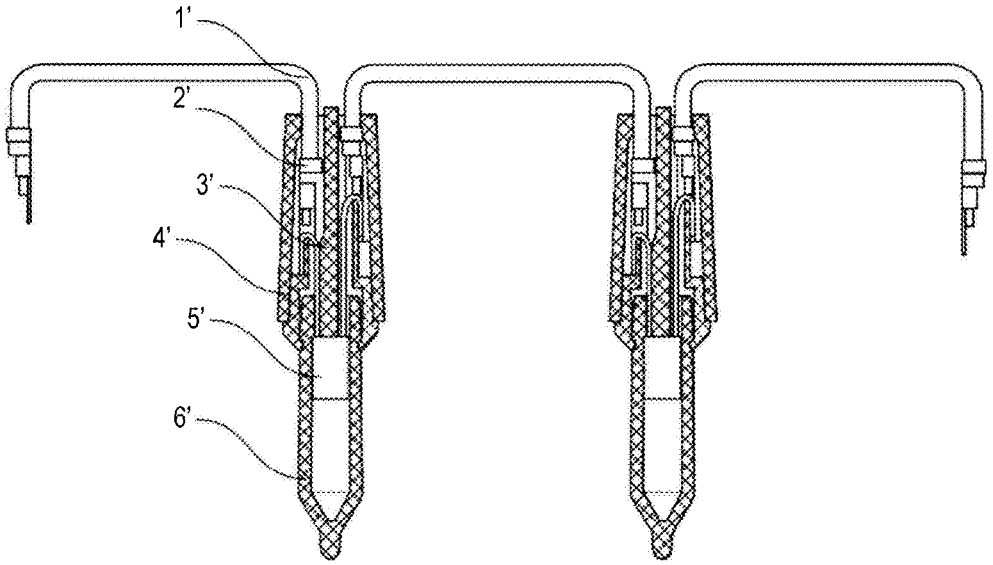
FIG. 2 (Prior Art)
FIG. 2 is a structure diagram of a decoration device of a Christmas light assembly.

Refer to FIG. 1, an illuminant decoration device that is configured, for example, for use on a Christmas light assembly, includes a lampshade 201, a clamping seat 202 and a light string 1; the light string 1 includes a lamp cap assembly 2 and a lead wire 3 comprising a lead wire end and interconnecting the lamp cap assembly 2; the lamp cap assembly 2 includes an LED bulb 212, an isolating pillar 213 and a heat shrinkable sleeve 214; the LED bulb 212 has a positive electrode bulb pin 221 and a negative electrode bulb pin 222, the lead wire end 211 is connected to the positive electrode bulb pin 221 and the negative electrode bulb pin 222 respectively through the lead wire 3, the isolating pillar 213 is arranged between the positive electrode bulb pin 221 and the negative electrode bulb pin 222, and the heat shrinkable sleeve 214 is wrapped around an outside of the lead wire end 211, the LED bulb 212 and the isolating pillar 213; the lampshade 201 and the clamping seat 202 are connected by way of clamping, an inner hole 203 is formed after the lampshade 201 and the clamping seat 202 are connected, the lamp cap assembly 2 fits within the inner hole, and glue is filled between the inner hole 203 and the lamp cap assembly 2.

Preferably, an arc clamping groove 231 is arranged at the outer ring of the lampshade 201, a fin plate 241 is arranged on the outside of the clamping seat 202, and the fin plate 241 is provided with a fixture block 251 fitting with the clamping groove 231.

Preferably, the lampshade 201 is transparent.

Preferably, the lampshade 201 is of a glass sharp bulb structure.

The illuminant decoration device according to the present disclosure offers the following advantages: this device has a simple structure, is suitable for to realizing automatic mass production and can effectively lowers the production cost; the lampshade may have the shape designed as needed, and thus enhances the decorative effect; meanwhile, people's consumption habits are taken in account; this structure has excellent water resistance and can be used both indoors and outdoors, and this device is provided with a lampshade, through which light rays become softer while the color and the shape become rich; in all, this device has a simple structure and low cost and is suitable for popularization.

The above shows and describes the basic principle, the main features and the advantages of the disclosure. Those skilled in the art should understand that the disclosure is not limited to the above embodiments; the description in the above embodiments and specification merely is the principle of the disclosure; various changes and improvements can be made to the disclosure without departing from the spirit and scope of the disclosure, and these changes and improvements all are included in the scope of protection of the disclosure. The protection scope of the disclosure is defined by claims appended herein and equivalents thereof.

What is claimed is:

1. An illuminant decoration device configured for use on a Christmas light assembly, wherein the illuminant decoration device comprises: a lampshade, a clamping seat and a light string; the light string comprises a lamp cap assembly and a lead wire comprising a lead wire end and interconnecting the lamp cap assembly; the lamp cap assembly comprises an LED bulb, an isolating pillar and a heat shrinkable sleeve; the LED bulb has a positive electrode bulb pin and a negative electrode bulb pin, the lead wire end is electrically connected to the positive electrode bulb pin and the negative electrode bulb pin respectively through the lead wire, the isolating pillar is arranged between the positive electrode bulb pin and the negative electrode bulb pin, and the heat shrinkable sleeve is wrapped around an outside of the lead wire end, the LED bulb and the isolating pillar; the lampshade and the clamping seat are connected by way of clamping, an inner hole is formed after the lampshade and the clamping seat are connected, the lamp cap assembly fits within the inner hole, and glue is filled between the inner hole and the lamp cap assembly.

2. The illuminant decoration device according to claim 1, wherein an arc clamping groove is arranged at an outer ring of the lampshade, a fin plate is arranged on an outside of the clamping seat, and the fin plate is provided with a fixture block fitting with the arc clamping groove.

3. The illuminant decoration device according to claim 1, wherein the lampshade is transparent.

* * * * *